US006634000B1

(12) United States Patent
Jammu et al.

(10) Patent No.: US 6,634,000 B1
(45) Date of Patent: Oct. 14, 2003

(54) ANALYZING FAULT LOGS AND CONTINUOUS DATA FOR DIAGNOSTICS FOR A LOCOMOTIVE

(75) Inventors: Vinay Bhaskar Jammu, Niskayuna, NY (US); William Roy Schneider, Erie, PA (US); Richard Gerald Bliley, Erie, PA (US); Anil Varma, Clifton Park, NY (US); Nicholas Edward Roddy, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/495,696

(22) Filed: Feb. 1, 2000

(51) Int. Cl.[7] ..... G06F 11/00
(52) U.S. Cl. ..... 714/37; 714/26
(58) Field of Search ..... 714/25, 26, 37

(56) References Cited

U.S. PATENT DOCUMENTS

| | | | | | |
|---|---|---|---|---|---|
| 5,127,005 | A | | 6/1992 | Oda | 371/15.1 |
| 5,287,505 | A | * | 2/1994 | Calvert et al. | 707/10 |
| 5,317,368 | A | * | 5/1994 | Shimomura et al. | 399/12 |
| 5,463,768 | A | | 10/1995 | Cuddihy et al. | 395/183.13 |
| 5,596,712 | A | * | 1/1997 | Tsuyama et al. | 714/26 |
| 5,799,148 | A | | 8/1998 | Cuddihy et al. | 395/183.02 |
| 5,845,272 | A | * | 12/1998 | Morjaria et al. | 706/45 |
| 5,944,839 | A | * | 8/1999 | Isenberg | 706/47 |
| 5,983,364 | A | * | 11/1999 | Bortcosh et al. | 714/25 |
| 5,984,427 | A | * | 11/1999 | Kettle, Jr. | 303/16 |
| 6,006,016 | A | * | 12/1999 | Faigon et al. | 714/26 |
| 6,041,425 | A | * | 3/2000 | Kokunishi et al. | 709/101 |
| 6,345,322 | B1 | * | 2/2002 | Humphrey | 710/38 |
| 6,415,395 | B1 | * | 7/2002 | Varma et al. | 714/37 |
| 6,473,659 | B1 | * | 10/2002 | Shah et al. | 700/79 |
| 6,480,972 | B1 | * | 11/2002 | Cromer et al. | 714/25 |
| 6,499,114 | B1 | * | 12/2002 | Almstead et al. | 714/25 |

OTHER PUBLICATIONS

Raaphorst et al. , "Automated fault–tree generation of operational fault–diagnosis," IEE Conference on Electric Railways in United Europe, pp. 173–177, Mar. 1995.

Netten et al., "Large–scale fault diagnosis for on–board train systems," Delft University of Technology , Faculty of Technical Mathematics and Informatics, Knowledge Based Systems Group. Julianallaan 132, 2628 BL Delft, The Netherlands; University of Wales Swansea, Department of Electrical and Electronic Engineering, Singleton Park, Swansea SA2 8PP, United Kingdom, pp. 67–76.

* cited by examiner

*Primary Examiner*—Robert Beausoliel
*Assistant Examiner*—Gabriel L. Chu
(74) *Attorney, Agent, or Firm*—Armstrong Teasdale LLP

(57) ABSTRACT

The present invention discloses a system and computer-implemented method for analyzing a fault log from a malfunctioning machine. The method includes receiving, from the malfunctioning machine, at least one of at least one fault code and at least one data code, at least one fault code and at least one anomaly code, and at least one data code and at least one anomaly code, and determining at least one of a cause of and a repair for the malfunctioning machine based on the at least one of the at least one fault code and the at least one data code, the at least one fault code and the at least one anomaly code, and the at least one data code and the at least one anomaly code. The method desirably includes receiving a fault log comprising at least one fault code and at least one data pack, parsing the at least one data pack, and generating at least one data pack code for a portion of the at least one parsed data pack. Desirably, the determining the at least one of the cause of and the repair for the malfunctioning machine is based on the at least one fault code and the at least one data pack code. Advantageously, the method includes using a belief network, or case-based reasoning.

31 Claims, 5 Drawing Sheets

30

32 34

| CUST | FLEET | RN | DWNLD DATE | TIME | HOURS | # FLTS |
|---|---|---|---|---|---|---|
| RR | | 1550 | 04/11/1999 | 10:03 | 107601.06 | 8 |

44

40 42

36

| OCCUR DATE | FAULT CODE | OCCUR HOURS | RESET HOURS | LOCO SPED | DIRECT | NOTCH | ENG SPED | VOLT | MAIN AMPS | ALT FLD | WAT TMP | OIL TMP | CALL | STATE | BLOWER | RADFAN | RADFN2 | BF | INFO | MISC. STATUS |
|---|---|---|---|---|---|---|---|---|---|---|---|---|---|---|---|---|---|---|---|---|
| APR-09 | 7222-02 | 107565.7 | 107569.5 | 2.4 | F | 1 | 442 | 399 | 254 | | 169 | 176 | M | E | F | 0 | | | 4 | AB-M-S-W |
| APR-10 | 7222-02 | 107568.5 | 107569.5 | 0.0 | C | 1 | 577 | 2 | 0 | | 171 | 171 | R | E | 2 | 0 | | | F | AB-———W |
| APR-10 | 7210-02 | 107577.2 | 107578.2 | 1.6 | R | 2 | 580 | 400 | 587 | | 156 | 158 | M | E | 2 | 0 | | | 4 | AB-M-S-- |
| APR-10 | 7219-02 | 107577.2 | 107578.2 | 1.9 | R | 1 | 555 | 399 | 268 | | 156 | 158 | M | E | 2 | 0 | | | 4 | AB-M-S-- |
| APR-10 | 7210-02 | 107577.2 | 0.0 | 2.1 | R | 1 | 439 | 402 | 278 | | 156 | 158 | M | E | 2 | 0 | | | 4 | AB-M-S-- |
| APR-10 | 730F-0C | 107580.2 | 107581.3 | 7.9 | F | 2 | 351 | 0 | 0 | | 172 | 174 | M | E | F | 0 | | | C | AB-M-S-W |
| APR-10 | 748F-0C | 107584.6 | 107585.7 | 0.0 | F | 1 | 332 | 0 | 0 | | 173 | 181 | R | E | F | 0 | | | F | AB-M-S-W |

FIG. 3

ANALYZING FAULT LOGS AND CONTINUOUS DATA FOR DIAGNOSTICS FOR A LOCOMOTIVE

BACKGROUND OF THE INVENTION

The present invention relates generally to machine diagnostics, and more specifically, to methods and systems for diagnosing fault logs and continuous data for recommendation of one or more causes of or one or more repairs for a malfunctioning machine.

A machine such as a locomotive includes elaborate controls and sensors that generate fault logs regarding the operation of the locomotive. Anomalous operating conditions of the locomotive are detected by the sensors and trigger the generation of an entry in the fault log.

Typically, each entry in a fault log includes the time and date the anomalous operating condition occurred, a fault code which corresponds to the detected anomalous operating condition (e.g., inverter failure, air conditioner compressor failure), and a data pack which contains additional information on the operating status of the locomotive (e.g., locomotive notch speed, engine speed, water temperature and oil temperature) at the time the anomalous operating condition occurred. Different anomalous operating conditions often cause similar fault codes, and a plurality of anomalous operating conditions occurring at the same time often result in a plurality of fault codes.

Typically, a field engineer will look at a fault log and using his experience and skill will attempt to determine the cause of the fault, whether a repair is necessary, and if so, the specific type of repair. If the fault log is complex, it is often difficult for the field engineer to diagnosis a cause of the fault or recommend a repair.

Computer-based systems have been used to diagnose problems in a locomotive. For example, computerized diagnostic tools have been developed for analyzing the fault codes from fault logs.

SUMMARY OF THE INVENTION

There is a need for a computer-based system and computerized method for enhancing analysis of a fault log for determining a cause of and/or recommending a repair for a malfunctioning machine. The above-mentioned need is met by the present invention which provides, in one aspect, a computer-implemented method for analyzing a fault log from a malfunctioning machine in which the computer-implemented method includes, receiving, from the malfunctioning machine, at least one of at least one fault code and at least one data code, at least one fault code and at least one anomaly code, and at least one data code and at least one anomaly code, and determining at least one of a cause of and a repair for the malfunctioning machine based on the at least one of the at least one fault code and the at least one data code, the at least one fault code and the at least one anomaly code, and the at least one data code and the at least one anomaly code. Advantageously, the determining comprises using a belief network, or case-based reasoning.

The present invention, in another aspect, provides a computer-implemented method for enabling diagnosis of a fault log in which the computer-implemented method includes receiving the fault log having a plurality of fault codes and a plurality of data packs from the malfunctioning machine, parsing the plurality of data packs, and generating a plurality of data pack codes for a portion of the parsed data packs.

Systems and computer program products corresponding to the above-summarized methods are also described and claimed herein.

BRIEF DESCRIPTION OF THE DRAWINGS

FIG. 3 is an illustration of a portion of a fault log for analysis in the system and by the process shown in FIGS. 1 and 2, respectively;

DETAILED DESCRIPTION OF THE INVENTION

Figure 1:
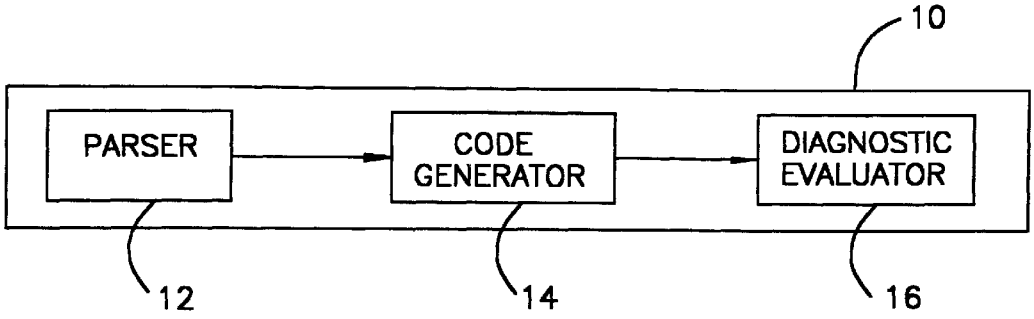
FIG. 1 is a block diagram of a system of the present invention.

FIG. 1 diagrammatically illustrates one embodiment of a system 10 of the present invention for diagnosing a malfunctioning machine and determining at least one of a cause of and a repair for the malfunctioning machine. Exemplary system 10 includes a parser 12, a code generator 14, and a diagnostic evaluator 16. By parsing a fault log from a machine, for example parsing the data pack or receiving anomaly codes as explained in greater detail below, the present invention provides an enhanced technique for diagnosing a cause of/or recommending a repair for a malfunctioning machine such as a locomotive.

Although the present invention is described with reference to a locomotive, system 10 can be used in conjunction with any machine in which operation of the machine is monitored, such as a chemical, an electronic, a mechanical, or a microprocessor machine.

With reference still to FIG. 1, parser 12 receives a fault log from and parses the fault log entries. The passed fault log is then evaluated and assigned codes by a code generator 14. Diagnostic evaluator 16 using the assigned codes determines a likely cause or causes of the malfunction or a likely repair or repairs for the locomotive.

Figure 2:
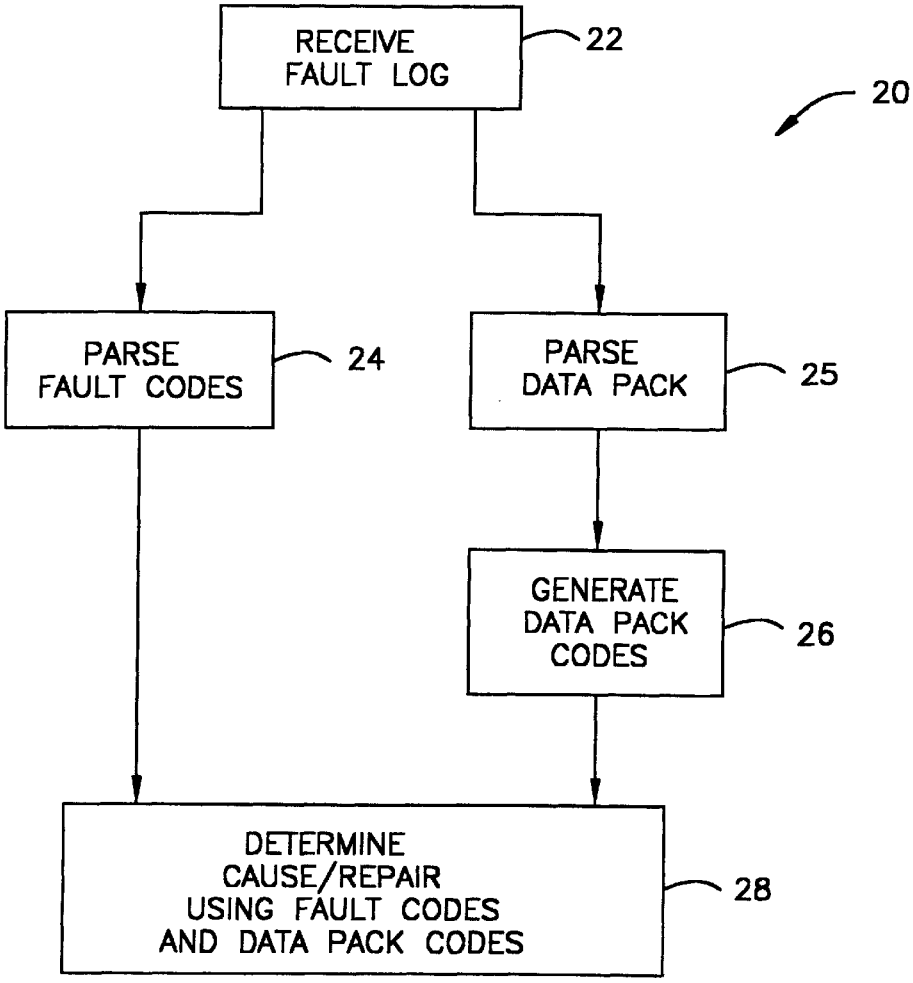
FIG. 2 is a flowchart illustrating a diagnostic process of the present invention for diagnosing a malfunctioning machine using the system shown in FIG. 1.

FIG. 2 is a flowchart illustrating a process 20 of the present invention for diagnosing a malfunctioning machine using system 10 (FIG. 1). Initially, a fault log from the locomotive is received at 22. A portion of a fault log 30, best shown in FIG. 3, typically includes a customer identification number 32, a locomotive identification number or unit 34, and a plurality of fault entries 36.

Each entry typically include a date 40 that the anomalous operating condition occurred, a fault code 42 associated with each anomalous operating condition, and a data pack 44 corresponding to a plurality of operating conditions of the locomotive at the time of the anomalous operating condition. Operating conditions often include locomotive speed, direction of travel, notch position, engine speed, etc. Desirably, fault log 30 includes a list of anomalous operating conditions occurring over a predetermined period of time prior such as a predetermined number of days (e.g., 14 days). It will be appreciated that other suitable time periods may be chosen.

With reference again to FIG. 2, fault codes 42 are parsed from fault log 30 at 24, and data pack 44 is parsed from fault log 30 at 25. The parsed portions, for example, locomotive speed, direction of travel, etc, of data pack 44 are then logically analyzed to extract significant information. Data pack rules are used for assigning data pack codes to the parsed data pack portions at 26.

For example, a data pack rule may be applied to any fault code. For instance, a data pack rule may analyze a data pack portion to determine if the water is over 200 degrees Fahrenheit and the oil temperature is greater than 45 degrees Fahrenheit over the water temperature and assign a data pack code, e.g., D020 (to indicate a cooling system problem). The data pack rules may also be fault code specific or apply to certain fault codes in the assignment of data pack codes to the parsed data pack portions. For instance, for a fault code indicating "water temperature is too hot," if the data pack also indicates that the water temperature is less than 200 degrees Fahrenheit, a data pack code can be assigned (as indicative of a bad water temperature sensor).

In addition, data pack codes may be generated and assigned based on analysis of two or more fault codes and one or more parsed portions of the data pack of the fault codes. For example, certain combinations of fault codes and a portion of the data pack may be more important than others in analyzing the cause of the anomalous operating condition or recommending a repair for the malfunctioning locomotive.

For instance, if two different fault codes regarding high current operating conditions in the traction motors, e.g., traction motor 1 high current and traction motor 4 high current, occur within two minutes and if the locomotive speed is greater than three miles per hour, and there was a change in direction, a data pack code can be assigned (which would indicate a wrong configuration file, i.e., wrong parameters loaded into the configuration file for triggering the fault).

The fault codes and the assigned data pack codes are then used to determine, at 28, one or more likely causes of or one or more likely repairs for the malfunctioning locomotive. The fault codes and data pack codes are desirably used as input to a computer-implemented diagnostic evaluator employing a belief network, case-based reasoning, etc. An example, of a belief network (e.g., Bayesian belief network) is described in U.S. Pat. No. 5,845,272, the entire subject matter of which is incorporated herein by reference. An example, of case-based reasoning is described in U.S. patent application Ser. No. 09/285,611, filed Apr. 2, 1999, and entitled "Method And System For Analyzing Fault Log Data For Diagnostics" (Attorney Docket No. 20-LC-1927), and U.S. patent application Ser. No. 09/285,612, filed Apr. 2, 1999_, and entitled "Method And System For Processing Repair Data And Fault Log Data to Facilitate Diagnostics" (Attorney Docket No. RD-26,576). The entire subject matter of these applications are hereby incorporated by reference.

Historical data of fault logs which resulted in one or more identified causes or one or more identified repairs can be used, e.g., by parsing the fault code and portions of the data pack, to generate weighted relations between the fault codes and data pack codes to the one or more causes or one or more repairs for use in a belief network or case-based reasoning.

For example, using the fault codes and the data pack codes, a belief network can be developed for the various systems of the locomotive, e.g., cooling system, fuel system, propulsion system, etc. In particular, the failure modes for each sub-system are identified, the cause and effect (e.g., fault codes and data pack codes) relationships for each of the failure modes are identified, prior probabilities indicating the likelihood of the failures are assigned, and an edge probability estimating the strength of the relationship between the failure mode and a next level effect node is assigned for each relationship. Once all of the belief networks have been developed, validated, and tested, then the networks are integrated-into the diagnostic knowledge base in the form of a belief network.

Figure 4:
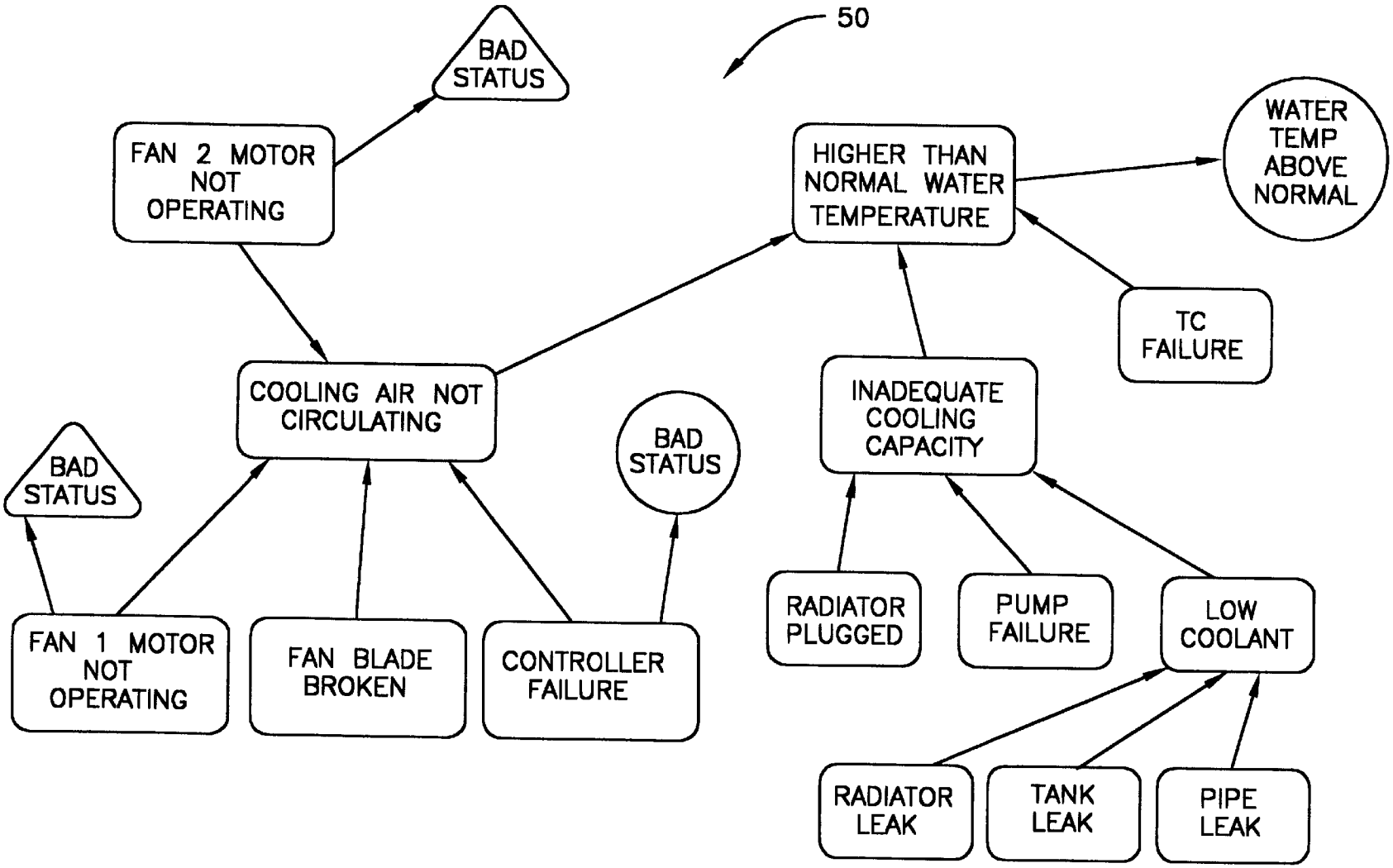
FIG. 4 is an illustration of a belief network of a locomotive engine cooling system for determining a cause of a malfunctioning machine.

FIG. 4 illustrates a belief network 50 for a locomotive engine cooling sub-system which incorporates fault codes and data pack codes. Fault codes in FIG. 4 are represented in circles and correspond to a water temperature above normal, and a bad status indication of a controller. Data pack codes in FIG. 4 are represented in triangles and correspond to a blower fan 1 bad status indication and a blower fan 2 bad status indication. Since fan 2 is not likely to be operating for low loads/engine speed, desirably a bad status indication of fan 2 is determined based on an indication that the fan 2 is not on (e.g., parsed portion of the data pack) and the engine speed (e.g., parsed portion of the data pack) being greater than a certain speed. Using the data pack codes increases the information extracted from the fault log thereby increasing the accuracy of the diagnostic network. Based on the given inputted fault codes and the data pack codes, the network then calculates the probabilities of the failure modes (e.g., rectangular boxes in FIG. 4) in the network according to the impact the fault codes and the data pack codes have on the network.

Figure 5:
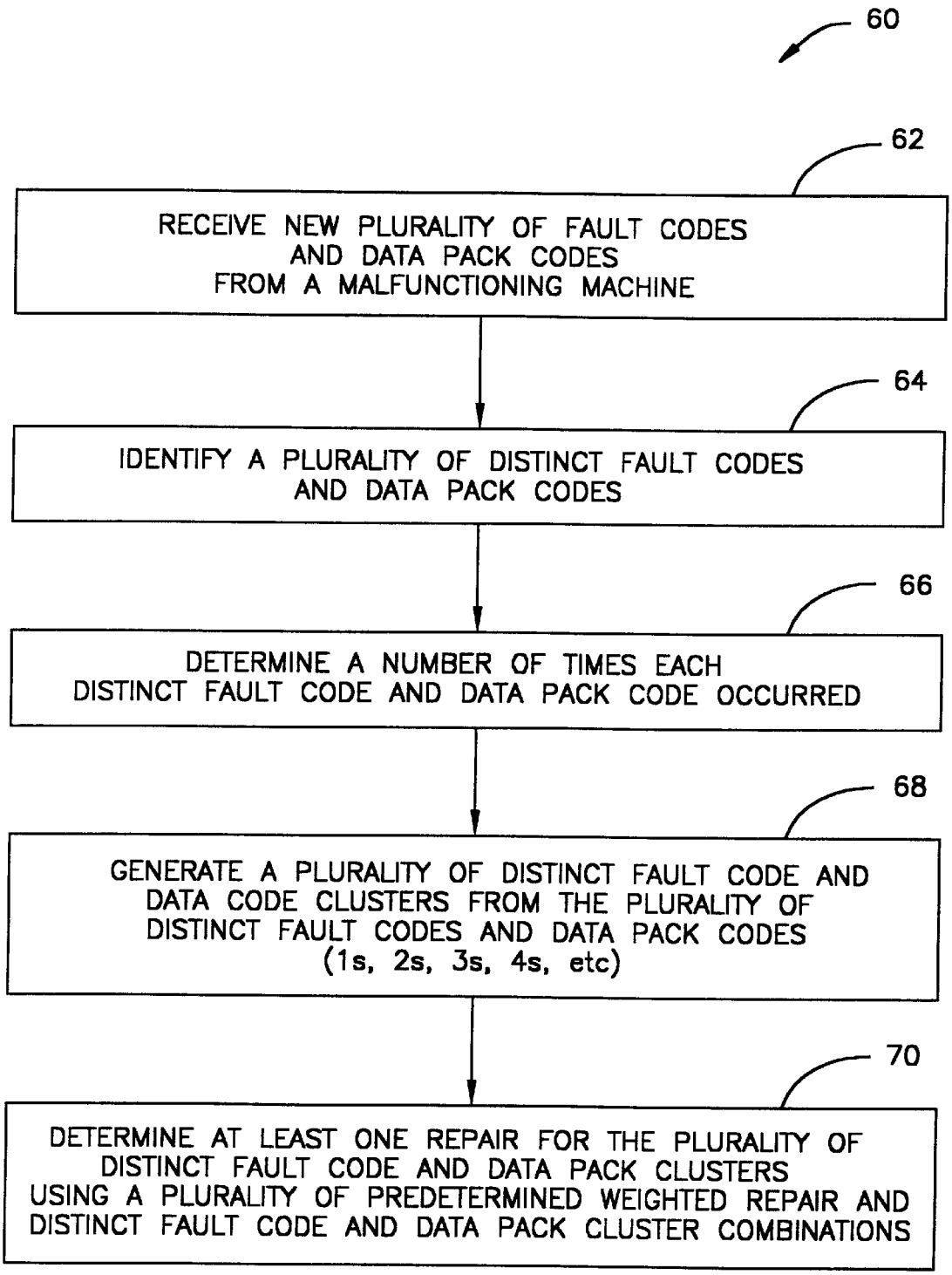
FIG. 5 is a flowchart describing the steps for analyzing a fault log from a malfunctioning machine and determining a repair.

FIG. 5 illustrates a flowchart of an exemplary case-based reasoning process 60 for analyzing fault log data 30 (FIG. 2) to determine at least one repair. The described case-based reasoning process below is only an example and other case-based reasoning approaches and techniques may be employed.

For example at 62, a plurality of fault codes and data pack codes, as determined above from fault log 30, arc received. At 64, a plurality of distinct fault codes and data pack codes are identified, and at 66, the number of times each distinct fault code and data pack code occurred in new fault log is determined.

As used herein, the term "distinct fault code and data pack code" is a fault code which differs from other fault codes or a data pack code which differs from other data pack codes so if the fault log being analyzed includes more than one occurrence of the same fault code or data pack code, similar fault codes or data pack codes are identified only once. As will become apparent from the discussion below, it is the selection of distinct fault codes and data pack codes in this example diagnostic evaluator which is important and not the order or sequence of their arrangement in the fault log.

A plurality of fault code and data pack code clusters is then generated for the distinct fault codes and data pack codes at 68. For example, a fault log having distinct fault codes and data pack codes, e.g., 7311, 728F, D015, and D020, results in the following fault code and data pack code clusters: four single fault code and data pack code clusters (e.g., 7311; 728F; D015; and D020), six double fault code and data pack code clusters (e.g., 7311 and 728F; 7311 and D015; 7311 and D002; 728F and D015; 728F and D020; and D015 and D020), four triple fault code and data pack code clusters (e.g., fault codes 7311, 728F, and D015; 7311, 728F, and D020; 7311, D015, and D020; and 728F, D015, and D020), and one quadruple fault code and data pack code clusters (e.g., 7311, 728F, D015, and D020).

From the present description, it will be appreciated by those skilled in the art that a fault log having a greater number of distinct fault codes and data pack codes would result in a greater number of distinct fault code and data pack clusters (e.g., ones, twos, threes, fours, fives, etc.).

At 70, at least one repair is predicted for the plurality of fault code and data pack code clusters using a plurality of predetermined weighted repair, fault code and data pack code cluster combinations. The plurality of such predetermined weighted cluster combinations may be generated as follows.

With reference again to FIG. 1, parser 12 and code generator 14 are desirably used to process historical fault logs (fault codes and data packs) which are related to corresponding repair data to create a plurality of related cases of repairs fault code and data pack code cluster combinations.

From the plurality of cases, weighted repair, fault code and data pack code cluster combinations are generated. For example, weighted repair, fault code and data pack code cluster combinations are generated by selecting a repair and a distinct fault code and data pack code cluster combination, and determining, the number of times the combination occurs for related repairs. A weight is determined for the repair, fault code and data pack code cluster combination by dividing the number of times the distinct fault code and data pack code cluster occurs in related cases by the number of times the distinct fault code and data pack code cluster occurs in all, e.g., related and unrelated cases. The weighted repair, fault code and data code cluster combinations can be desirably stored in a directed weight data storage unit (not shown).

The weighted repair, fault code and data pack code cluster combinations are used to assign a weight to each of the distinct fault code and data pack code clusters generated for a new fault log. Each assigned weight or the combined assigned weight for a repair are used in recommending one or more repairs.

Figure 6:
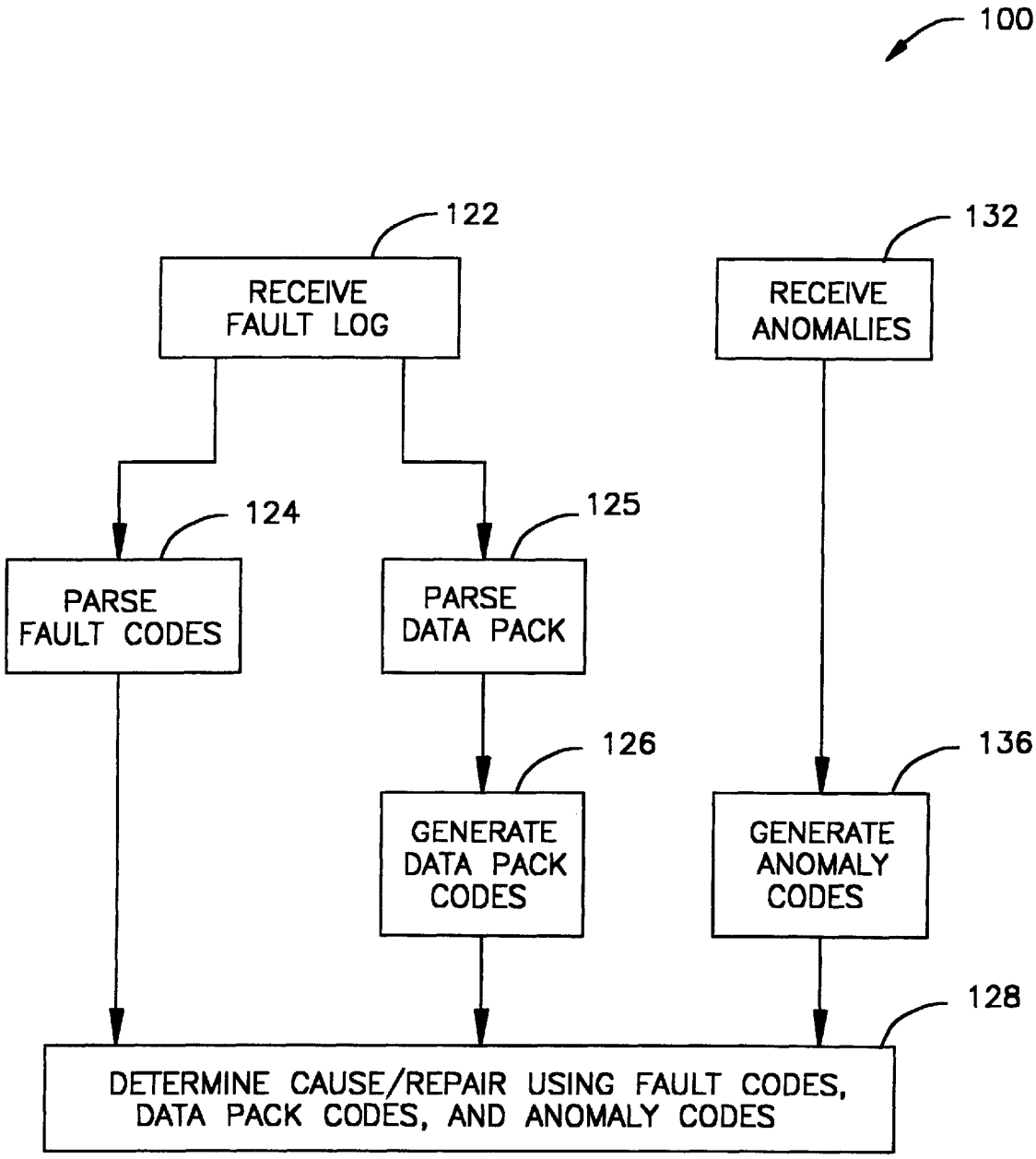
FIG. 6 is a flowchart illustrating an alternative diagnostic process of the present invention for diagnosing a malfunctioning machine using the system shown in FIG. 1.

FIG. 6 illustrates an alternative embodiment of a process 100 of the present invention which includes receiving a fault log at 122, and receiving anomalies at 132. For example, an anomaly may be detected by a sensor that is not typically used in the generation of the fault log.

For example, various sensors may be used for monitoring performance of the diesel engine, such as fuel flow rate, ambient air temperature, air barometric pressure, fuel temperature, etc. and be used in aiding determining the cause or repair of an anomalous operating condition such as a fuel pump failure or high pressure pump failure. Various algorithms can be used for monitoring the sensors and triggering an anomaly. Such an approach allows for continuous monitoring of a stream of data or periodic acquiring of data, e.g., every 10 minutes, which is in contrast to the data pack which corresponds in time to the occurrence of the fault code.

In this exemplary process, the anomaly is desirably assigned an anomaly code at 136. The fault codes, parsed data pack codes, and anomaly codes are then used, in a similar manner as described above regarding the belief network and case-based reasoning, to determine one or more likely causes of the malfunction and one or more likely repairs.

From the present description, it will be appreciated by those skilled in the art that the determination of the cause or the repair of the malfunctioning machine may be based on at least one fault code and at least one data code, or at least one fault code, at least one data code, and at least one anomaly code, as well as and in a similar manner at least one fault code and at least one anomaly code, or at least one data code and at least one anomaly code.

Whether determined by belief network or by case-based reasoning, the result of the diagnostic evaluation, e.g., recommendation as to the likely cause or repair, can be printed out or displayed for review by a field engineer. Advantageously, the top most likely causes or repairs are determined and presented for review by a field engineer.

The present invention may be employed in the elaborate control system of the locomotive or the fault log generated and stored and downloaded for processing for analysis at a remote site.

An example of a computing environment for incorporating and using the diagnosing capabilities and techniques of the present invention includes, for instance, at least one central processing unit or processor, a memory or main storage, and one or more input/output devices, as is well known in the art. For example, such a computing environment may includes a PENTIUM processor running a WINDOWS operating system. Alternatively, the computing environment may include or be incorporated into the locomotive's elaborate control system. The diagnostic techniques of the present invention may be readily programmed by those skilled in the art for use in such a computer environment. Data may be analyzed in real-time onboard the locomotive, sent via the Internet or via satellite for analysis remote form the locomotive, or stored and later downloaded, e.g., transmitted via e-mail, for analysis.

The above-described computing environment is only offered as examples. The present invention can be incorporated and used with many types of computing units, computers, processors, nodes, systems, work stations or environments without departing from the spirit of the present invention.

In addition, the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flowcharts or flow diagrams depicted herein are exemplary. There may be many variations to these diagrams or the steps (or operations) described therein without departing from the spirit of the invention. For instance, the steps may be performed in a differing order, or steps may be added, deleted or modified. All of these variations are considered a part of the claimed invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A computer-implemented method for analyzing a malfunctioning machine, the computer-implemented method comprising:

receiving, from the malfunctioning machine comprising a locomotive engine, at least one of at least one fault code and at least one data code, at least one fault code and at least one anomaly code, and at least one data code and at least one anomaly code wherein each fault code is associated with an anomalous operating condition of a locomotive, each data code includes operating conditions of the locomotive at the time of the anomalous operating condition, and wherein each anomaly code is indicative of an anomalous operating condition based on continuous monitoring of a stream of data; and determining at least one of a cause of and a repair for the malfunctioning machine based on the at least one of the at least one fault code and the at least one data code, the at least one fault code and the at least one anomaly code, and the at least one data code and the at least one anomaly code.

2. The computer-implemented method of claim 1 wherein the receiving comprises receiving a fault log comprising at least one fault code and at least one data pack, parsing the at least one data pack and generating at least one data pack code for a portion of the at least one parsed data pack, and wherein the determining comprises determining the at least one of the cause of and the repair for the malfunctioning machine based on the at least one fault code and the at least one data pack code.

3. The computer-implemented method of claim 2 wherein the at least one data pack code is based on at least one fault code.

4. The computer-implemented method of claim 2 wherein the at least one data pack code is based on a plurality of fault codes.

5. The computer-implemented method of claim 1 wherein the determining comprises determining the at least one of the cause of and the repair for the malfunctioning machine based on the at least one fault code, the at least one data pack code, and the at least one anomaly code.

6. The computer-implemented method of claim 5 wherein the at least one anomaly code is generated from a generally continuous data stream.

7. The computer-implemented method of claim 1 wherein the determining comprises using a belief network.

8. The computer-implemented method of claim 1 wherein the determining comprises using case-based reasoning.

9. The computer-implemented method of claim 8 wherein the determining comprises generating from the at least one fault code and the at least one data pack code at least one distinct fault code and data pack code cluster, and determining the at least one of the cause of and the repair for the malfunctioning machine based on the at least one distinct fault code and data pack code cluster.

10. A computer-implemented method for enabling diagnosis of a fault log, the method comprising:

receiving the fault log comprising a plurality of fault codes and a plurality of data packs from a malfunctioning machine comprising a locomotive engine wherein each fault code is associated with an anomalous operating condition of a locomotive, and wherein each data pack includes operating conditions of the locomotive at the time of the anomalous operating condition;

parsing the plurality of data packs; and generating at least one data pack code for the parsed data packs.

11. The computer-implemented method of claim 10 wherein the at least one data pack code is based on at least one fault code.

12. The computer-implemented method of claim 10 wherein the at least one data pack code is based on a plurality of fault codes.

13. The computer-implemented method of claim 10 further comprising receiving at least one anomaly and generating at least one anomaly codes for the at least one anomaly.

14. The computer-implemented method of claim 13 wherein the at least one anomaly code is generated from a generally continuous data stream.

15. A system for analyzing a malfunctioning machine, said system comprising:

means for receiving, from the malfunctioning machine comprising a locomotive engine, at least one of at least one fault code and at least one data pack code, at least one fault code and at least one anomaly code, and at least one data code and at least one anomaly code wherein each fault code is associated with an anomalous operating condition of a locomotive, each data pack code includes operating conditions of the locomotive at the time of the anomalous operating condition, and wherein each anomaly code is indicative of an anomalous operating condition based on continuous monitoring of a stream of data; and means for determining at least one of a cause of and a repair for the malfunctioning machine based on the at least one of the at least one fault code and the at least one data code, the at least one fault code and the at least one anomaly code, and the at least one data code and the at least one anomaly code.

16. The system of claim 15 wherein means for receiving comprises means for receiving a fault log comprising at least one fault code and at least one data pack, means for parsing the at least one data pack, and means for generating at least one data pack code for a portion of the at least one parsed data pack, and wherein said means for determining comprises means for determining the at least one of the cause of and the repair for the malfunctioning machine based on the at least one fault code and the at least one data pack code.

17. The system of claim 16 wherein the at least one data pack code is based on at least one fault code.

18. The system of claim 16 wherein the at least one data pack code is based on a plurality of fault codes.

19. The system of claim 15 wherein said means for determining comprises means for determining the at least one of the cause of and the repair for the malfunctioning machine based on the at least one fault code, the at least one data pack code, and the at least one anomaly code.

20. The computer-implemented method of claim 19 wherein the at least one anomaly code is generated from a generally continuous data stream.

21. The system of claim 15 wherein said means for determining comprises a belief network.

22. The system of claim 15 wherein said means for determining comprises case-based reasoning.

23. The system of claim 22 wherein the means for determining comprises means for generating from the at least one fault code and the at least one data pack code at least one distinct fault code and data pack code cluster, and means for determining the at least one of the cause of and the repair for the malfunctioning machine based on the at least one distinct fault code and data pack code cluster.

24. A system for enabling diagnosis of a fault log, said system comprising:

a processor adapted to receive the fault log comprising a plurality of fault codes and a plurality of data packs from a malfunctioning machine comprising a locomotive engine wherein each fault code is associated with an anomalous operating condition of a locomotive, and wherein each data pack includes operating conditions of the locomotive at the time of the anomalous operating condition;

said processor adapted to parse the plurality of data packs; and said processor adapted to generate at least one data pack code for the parsed data packs.

25. The system of claim 24 wherein said at least on data pack code is based on at least one fault code.

26. The system of claim 24 wherein said at least on data pack code is based on a plurality of fault codes.

27. The system of claim 24 further comprising said processor adapted to receive at least one anomaly and generate at least one anomaly code.

28. The system of claim 27 wherein said at least one anomaly code is generated from a generally continuous data stream.

29. At least one program storage device readable by a machine, tangibly embodying at least one program of instructions executable by the machine to perform a method for analyzing a malfunctioning machine, the method comprising:

receiving, from the malfunctioning machine comprising a locomotive engine, at least one of at least one fault code and at least one data code, at least one fault code and at least one anomaly code, and at least one data code and at least one anomaly code wherein each fault code is associated with an anomalous operating condition of a locomotive, each data code includes operating conditions of the locomotive at the time of the anomalous operating condition, and wherein each anomaly code is indicative of an anomalous operating condition based on continuous monitoring of a stream of data; and determining at least one of a cause of and a repair for the malfunctioning machine based on the at least one of the at least one fault code and the at least one data code, the at least one fault code and the at least one anomaly code, and the at least one data code and the at least one anomaly code.

30. The at least one program storage device of claim 29 wherein the receiving comprises receiving a fault log comprising at least one fault code and at least one data pack, parsing the at least one data pack and generating at least one data pack code for a portion of the at least one parsed data pack, and wherein the determining comprises determining the at least one of the cause of and the repair for the malfunctioning machine based on the at least one fault code and the at least one data pack code.

31. An article of manufacture, comprising:

at least one computer usable medium having computer readable program code means embodied therein for enabling diagnosis of a fault log, the computer readable program code means in said article of manufacture comprising:

computer readable program code means for causing a computer to receive the fault log comprising a plurality of fault codes and data packs from a malfunctioning machine comprising a locomotive engine wherein each fault code is associated with an anomalous operating condition of a locomotive, and wherein each data pack includes operating conditions of the locomotive at the time of the anomalous operating condition;

computer readable program code means for causing a computer to parse the plurality of data packs; and computer readable program code means for causing a computer to generate at least one data pack code for the parsed data packs.

* * * * *

UNITED STATES PATENT AND TRADEMARK OFFICE

CERTIFICATE OF CORRECTION

PATENT NO. : 6,634,000 B1
DATED : October 14, 2003
INVENTOR(S) : Jammu et al.

It is certified that error appears in the above-identified patent and that said Letters Patent is hereby corrected as shown below:

Column 9,
Lines 5 and 7, delete “on” and insert therefor -- one --.

Signed and Sealed this

Sixth Day of April, 2004

JON W. DUDAS
*Acting Director of the United States Patent and Trademark Office*